US008567212B2

(12) United States Patent
Guitari

(10) Patent No.: US 8,567,212 B2
(45) Date of Patent: Oct. 29, 2013

(54) STORAGE DEVICE COMPRISING A TURBULATING MEAN

(75) Inventor: Imed Guitari, Elancourt (FR)

(73) Assignee: Valeo Systems Thermiques, Les Mesnil Saint Denis, Cedex (FR)

( * ) Notice: Subject to any disclaimer, the term of this patent is extended or adjusted under 35 U.S.C. 154(b) by 835 days.

(21) Appl. No.: 12/699,152

(22) Filed: Feb. 3, 2010

(65) Prior Publication Data

US 2010/0199713 A1 Aug. 12, 2010

(30) Foreign Application Priority Data

Feb. 9, 2009 (FR) ..... 09 00556

(51) Int. Cl.
*F25B 43/00* (2006.01)

(52) U.S. Cl.
USPC ..... 62/503

(58) Field of Classification Search
USPC ..... 62/502, 503, 474, 114
See application file for complete search history.

(56) References Cited

U.S. PATENT DOCUMENTS

| | | | | |
|---|---|---|---|---|
| 4,768,355 | A * | 9/1988 | Breuhan et al. | 62/503 |
| 4,827,725 | A * | 5/1989 | Morse | 62/503 |
| 5,551,255 | A * | 9/1996 | Rothfleisch | 62/502 |
| 5,787,729 | A * | 8/1998 | Wijaya | 62/503 |
| 6,314,750 | B1 | 11/2001 | Ishikawa et al. | |
| 6,598,422 | B1 | 7/2003 | Smith | |
| 7,690,219 | B2 * | 4/2010 | Suzuki et al. | 62/512 |
| 2002/0095948 | A1 * | 7/2002 | Corrigan et al. | 62/503 |

FOREIGN PATENT DOCUMENTS

| | | | |
|---|---|---|---|
| DE | 544701 | C | 2/1932 |
| EP | 1967800 | A1 | 9/2008 |
| FR | 1415421 | A | 10/1965 |

OTHER PUBLICATIONS

English language translation for DE 544701, 5 pages.
English language translation for FR1415421, 8 pages.
INPI Institut National De La Propriete Industrielle Search Report for FA 717507 / FR 0900556, dated Sep. 9, 2009, 1 page.

* cited by examiner

*Primary Examiner* — Melvin Jones
(74) *Attorney, Agent, or Firm* — Howard & Howard Attorneys PLLC

(57) ABSTRACT

The invention relates to a storage device 1 of a suitable refrigerant fluid circulating in a cooling loop, the device comprising at least an input tube 18, an output tube 19 and a storage area 10 of refrigerant, wherein a mean 16 is provided to cause turbulence in the storage area 10. Application is to an A/C loop or a circuit for an air conditioning system of a motor vehicle.

15 Claims, 2 Drawing Sheets

STORAGE DEVICE COMPRISING A TURBULATING MEAN

RELATED APPLICATIONS

Figure 1:
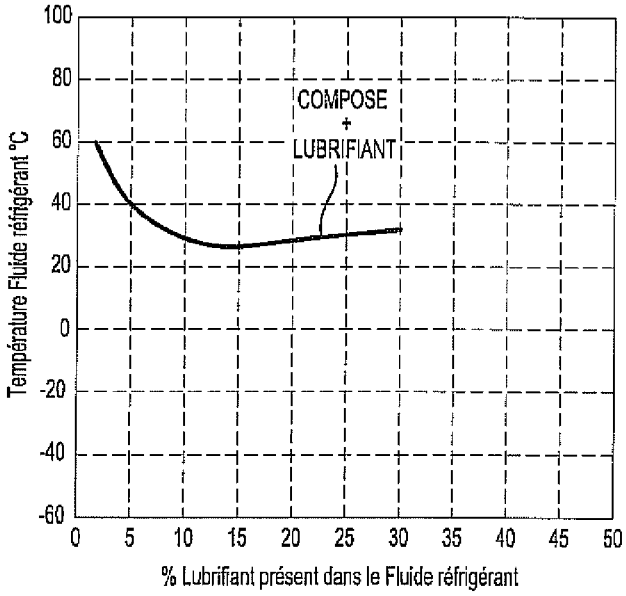

This application claims priority to and all the advantages of French Patent Application No. FR 09/00556, filed on Feb. 9, 2009.

This invention relates to the field of air conditioning loops cooperating with a heating, ventilation and/or air conditioning system of a motor vehicle. It relates to a storage device used in such a loop, which is better known as a cylinder or an accumulator. It also relates to an air conditioning loop including such a storage device.

Motor vehicles are commonly equipped with a heating, ventilation and/or air conditioning system in order to regulate the aerothermal parameters of the air contained in the vehicle interior. Such a system cooperates with an air conditioning loop in order to cool the air flow before it is delivered from the latter to the vehicle interior. Said loop includes a plurality of elements or components inside of which the following circulate in series: a component, such as a sub-critical fluid, HFO1234YF in particular with which a known lubricant is mixed, for example under reference ISO100PAG or ISO200PAG. The index 100 or 200 describes the grade and therefore the viscosity of the lubricant and PAG stands for PolyAlkylene Glycol. For example, ISO 100 corresponds to a kinematic viscosity close to 100 $mm^2/s$ or cSt at 40° C., measured according to the international standard ISO. The component and lubricant mixture forms the coolant, which circulates in the air conditioning loop. The components include at least one compressor, a condenser, an expansion member, an evaporator and an accumulator or a cylinder. The lubricant is intended to lubricate primarily the internal parts of the compressor.

The coolant circulates from the compressor to the condenser, then through a cylinder when the loop is equipped with one (instead of an accumulator), then toward the expansion member, then through the evaporator, then to an accumulator when the loop is equipped with one (instead of the cylinder), and then returns to the compressor.

The compressor is intended to receive the coolant in the gaseous state and to compress it in order to bring it to high pressure and high temperature. The condenser is capable of cooling the compressed coolant, at a relatively constant pressure, by transferring heat to the environment. The expansion member is capable of reducing the pressure of the coolant leaving the condenser by bringing it to the liquid state. The evaporator is suitable for converting the coolant from the gaseous state to the liquid state coming from the expansion member, at a relatively constant pressure, by drawing heat in said air flow passing through the evaporator. The vaporized coolant is then suctioned by the compressor.

The accumulator or the cylinder performs a function of storing a circulating load of coolant according to the conditions of use of the air conditioning loop. The accumulator also performs a function of separating a gaseous phase and a liquid phase of the coolant leaving the evaporator.

In general, the accumulator consists of a chamber housing an internal volume used partially as an accumulation area for the coolant. Thus, the coolant in the liquid state accumulates by gravity in the storage or accumulation area.

To avoid deterioration of the compressor, it is necessary for the oil content in the coolant to be at least equal to the requirements of the compressor, these requirements being known as the oil return rate. The oil return rate for a fixed-displacement compressor for a variable-displacement compressor is generally on the order of 5%.

However, the miscibility of the HFO1234YF component and the 100PAG or 200PAG oil is variable according to the temperature of the coolant. Situations may arise in which the coolant reaches a high temperature, in particular 40° C. at the outlet of the condenser, which significantly reduces the level of lubricant-component miscibility until it goes below the oil return rate of the compressor. In other words, there is a risk that the compressor will receive less oil than necessary for proper operation, which, at the very least, will reduce its lifetime and, at worst, will result in an immediate malfunction thereof. A solution for solving this problem is to use another component such as a fluorinated compound known by reference R134a. However, R134a has a very negative greenhouse effect, which is not the case of the HFO1234YF component.

The objective of this invention is therefore to solve the above-mentioned problem of miscibility by simple means, in which the installation at the core of an air conditioning loop will not disrupt the thermal performance of said loop.

The invention therefore relates to a device for storing a coolant capable of circulating in an air conditioning loop, in which said device includes at least one inlet tube or opening, one outlet tube or opening and a storage area for said coolant. The device is innovative in that it includes means intended to cause turbulence in the storage area. These means intended to cause turbulence mechanically force the mixing of the component and the lubricant so as to prevent the stratification into layers of the compound and the lubricant. These means are therefore a mixer, powered by the circulation of the coolant in the air conditioning loop.

According to a first feature of the invention, the means intended to cause turbulence take the form of a manifold, which channels the coolant coming from an intake chamber toward the storage area. This manifold is in the form of a conduit, which concentrates the coolant into a jet.

According to a second feature of the invention, the manifold is directly connected to the inlet tube and has a semi-cylindrical shape, in which the free end of said manifold is opposite the storage area. The arc formed by the semi-cylindrical shape enables the jet to be directed toward the storage area so as to force the jet of coolant hit the upper layer of fluid stored in the storage area.

According to another feature of the invention, the manifold is distinct from the inlet tube, and said manifold is supported by a plate that divides the internal volume of the storage device in a sealed manner into an intake chamber and said storage area. By "distinct", we mean that the manifold and the inlet tube are not directly connected to one another.

According to another feature of the invention, the manifold and the inlet tube are coaxial, and the inlet tube passes through a discharge chamber separated from said storage area by a plate.

According to another feature of the invention, the manifold passes through said plate and leads into the storage area.

The diameter of the manifold is between four and eight millimeters.

The outlet tube communicates with the discharge chamber and with the settling chamber. Thus, the coolant in the gaseous state is captured in the discharge chamber and a small amount of coolant (component and lubricant) is captured in the settling chamber.

Advantageously, the device includes an element permeable to the coolant placed in the internal volume of said device at the border between said storage area and the settling chamber.

The permeable element is a grate or a filter.

The invention also relates to an air conditioning loop or circuit including a storage device including any one of the features mentioned above, and in which a coolant consisting of a mixture of the component and a lubricant circulates, in which said component is a sub-critical fluid known by reference HFO1234YF and the lubricant is an oil known by reference 100PAG or 200PAG. The use of other lubricants such as POE (Polyol-ester) or a mineral oil is covered by the invention, more specifically if the compressor used by the air conditioning loop is an electric compressor (POE lubricant).

A very first advantage according to the invention lies in the maintenance of a level of miscibility between a component and a lubricant above a return rate of a given compressor.

Another advantage lies in the possibility of using, as a coolant in air conditioning loops, in particular for motor vehicles, a component with a small carbon footprint.

Another non-negligible advantage lies in the mixture of said component with a lubricant having proven properties and of which the cost remains low.

Figure 2:
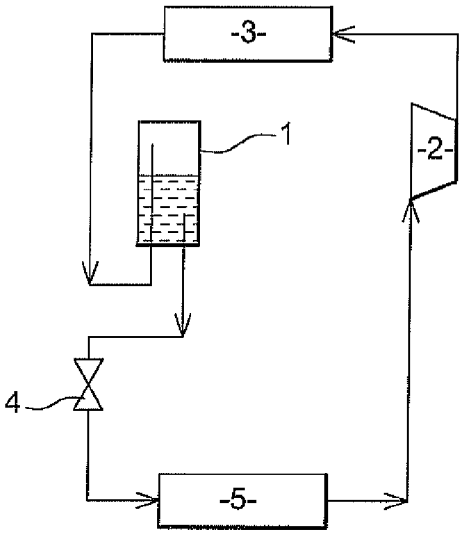
Figure 3:
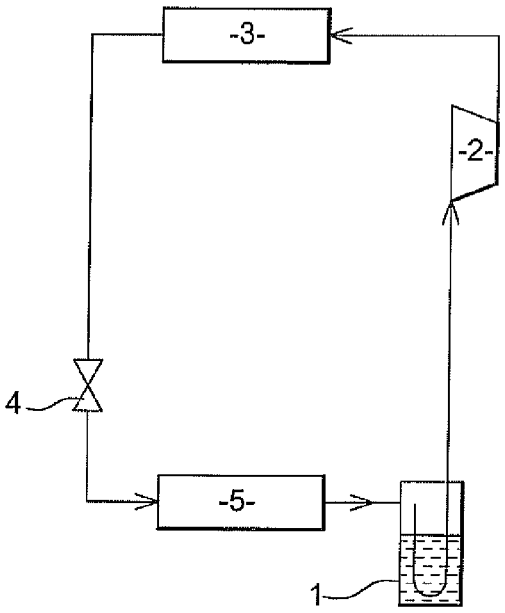
Figure 4:
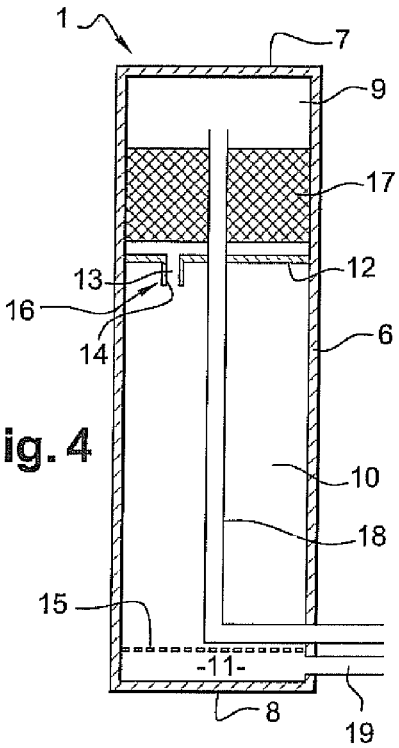
Figure 5:
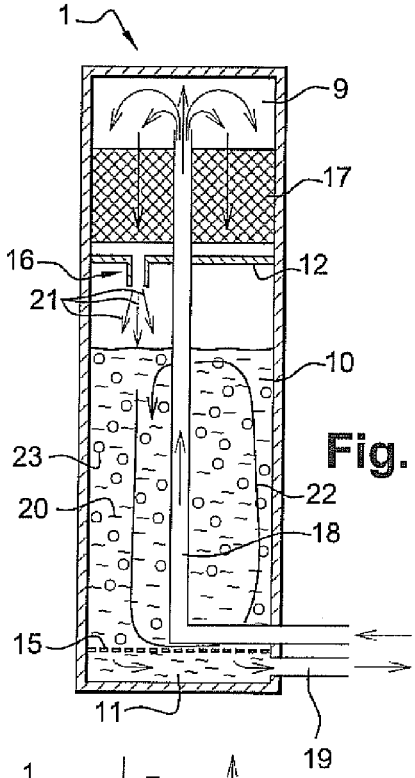
Figure 6:
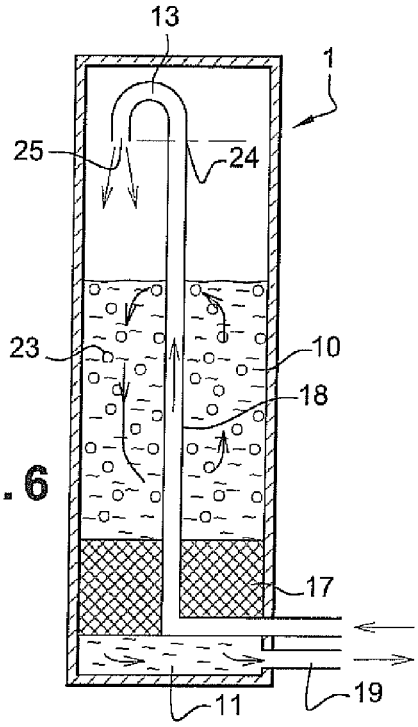
Figure 7:
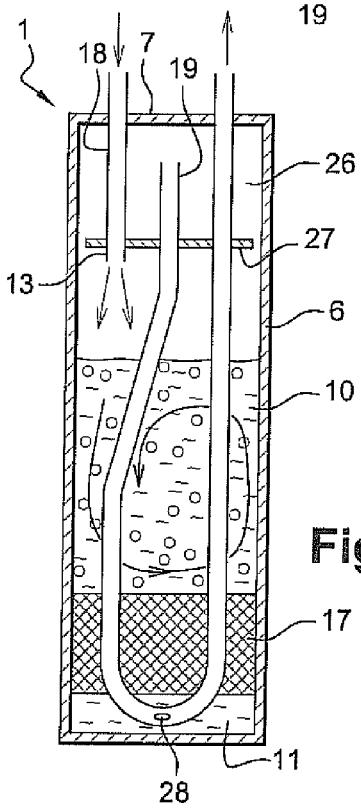

Other features, details and advantages of the invention will become clearer in view of the following description provided for illustrative purposes, in association with the drawings, in which:

FIG. 1 is a graph of miscibility with respect to temperature between the HFO1234YF compound and a lubricant, FIG. 2 is a view showing a first alternative of an air conditioning loop, FIG. 3 is a diagrammatic view of an air conditioning loop according to a second alternative, FIG. 4 is a diagrammatic view of a first alternative of the invention, FIG. 5 is a view similar to that of FIG. 4, but showing the phenomenon, FIG. 6 is a diagrammatic view of a second alternative of the invention, FIG. 7 is a diagrammatic view of a third alternative of the invention.

The figures are useful for a technical understanding of the invention, but may of course better delimit the invention, as the case may be.

FIG. 1 shows the technical problem. It shows a two-dimensional graph in which the x-axis represents the percentage of lubricant in the coolant, which ranges from 0% at the left-hand side to 50% at the right-hand side. The y-axis of this graph shows the temperature of the coolant in the loop measured at the inlet of the storage device according to the invention. The black curve entitled "COMPOUND+LUBRICANT" shows the behavior of a compound and lubricant mixture, for example for the component known by the acronym HFO1234YF mixed with an oil or lubricant known by reference 100PAG. It is noted that at 30° C., the percentage of oil in the coolant is 10%, which is greater than the oil return rate commonly known for a fixed-displacement compressor for example, 5%. It is therefore understood that the coolant transports enough oil to prevent any deterioration of the compressor. However, for operation of the air conditioning loop at high external temperatures (above 35° C.) or in traffic jams (slowed speed) in which a hot air return in the condenser causes an increase in the temperature surrounding the latter, the amount of lubricant in the coolant falls below the oil return rate, which results in a deterioration of the parts inside the compressor and malfunction thereof.

FIG. 2 shows a first alternative of an air conditioning loop that incorporates the storage device 1 according to the invention. The loop includes a compressor 2, which can be with fixed-displacement, internal control or external control. The compressor, which compresses the coolant in the gaseous state and raises the temperature thereof, is connected by a conduit to a condenser 3, which has the task of cooling the gas circulating through it by exchange with an air flow outside the motor vehicle. This condenser 3 has an outlet connected by a conduit to the inlet of the storage device 1. In FIG. 2, this storage device is also called a cylinder, in particular dehydrating when the latter is equipped with a dehydration module.

The storage device 1 is connected by an outlet to an expansion member 4, advantageously a calibrated opening, of which the function is to reduce the pressure of the coolant (expansion) and thus reduce the temperature thereof. The expansion member 4 is connected to an evaporator 5 where the coolant will exchange and cool air sent into the interior of the motor vehicle. The air conditioning loop is closed by the return of the coolant via a conduit connected between the evaporator 5 and an inlet of the compressor 2.

FIG. 3 shows a second alternative of an air conditioning loop similar to the first alternative shown in FIG. 2, with the exception of the following points. The storage device 1 is in this case an accumulator placed at the evaporator outlet 5 and upstream of the inlet of the compressor 2. The expansion member 4 is a thermostatic expansion valve of which the control is dependent on the temperature of the coolant at the outlet of the evaporator 5.

FIG. 4 shows the storage device 1 according to a first alternative embodiment. This storage device 1 is delimited with respect to the outside by a peripheral wall 6 that is in the form of a tube with a circular cross-section closed at the ends thereof by an upper wall 7 and a lower wall 8. The peripheral wall 6, the upper wall 7 and the lower wall 8 define an internal volume that is distributed into an intake chamber 9, a storage area 10 and a settling chamber 11.

The intake chamber 9 is arranged in the upper portion of the internal volume and receives the coolant in the liquid state when the latter comes from the condenser, i.e. when the storage device 1 is used as a cylinder. A plate 12 divides the internal volume in the upper portion thereof so as to separate the intake chamber 9 from the storage are 10. This plate 12 is mounted in the internal volume in a sealed manner on the internal face of the peripheral wall 6, i.e. without communication between the intake chamber 9 and the storage area 10 outside of that provided in order to create or cause turbulence.

The plate 12 has means 16 intended to cause turbulence in the storage area 10, which are produced by an opening or hole formed through the plate 12 and which forms a manifold 13 for allowing the circulation of the coolant from the intake chamber 9 to the storage area 10. The term manifold covers the hole formed in the thickness of the plate 12 and also covers a small pipe 14 of which the free section is placed in the extension of the hole so as to channel the coolant flow; these provisions are combined under the phrase "means 16 intended to cause turbulence". In other words, the manifold 13 is formed by a hole, a small pipe 14 or any means 16 for communication between the intake chamber 9 and the storage area 10 of which the open section represents less than one-tenth of the section of the peripheral wall 6 plumb over the plate and which is capable of causing turbulence in the storage chamber so as to mix the lubricant and the component.

In the case shown in FIG. 4, the small pipe 14 is a hollow circular manifold with an internal diameter of between four and eight millimeters, in which this range of values yields good performance in the mixing of the lubricant and the component in the storage area. Said small pipe 14 is advantageously welded onto the plate 12 so as to cause the hollow section to correspond with the hole formed in said plate 12.

A settling chamber 11 is provided in the bottom portion of the storage device 1 and below the storage area 10. This settling chamber 11 is therefore delimited by a lower wall 8, a portion of the peripheral wall 6 and an element 15 permeable to the coolant. The element 15 is intended to allow the coolant to pass in order to enable it to leave the device according to the invention, while preventing the turbulence in the storage area 10, and caused by the means 16 according to the invention, from being propagated into the settling chamber 11. In the case of FIGS. 4 and 5, the element 15 is in the form of a grate secured to the peripheral wall 6. In the case of FIGS. 6 and 7, the element 15 takes the form of a filter.

The storage device according to the first alternative comprises a filter 17 that is placed in the intake chamber 9, above the plate 12. This filter 17 is passed through by the coolant in the liquid state.

The device according to the invention also includes means for channeling the coolant from the outside of the device to the intake chamber. These means consist of an inlet tube 18 that passes through the peripheral wall 6 substantially next to the element 15, and continues by forming a right-angle bend. This inlet tube 18 passes through the plate 12 and the filter 17 so as to lead into the intake chamber 9 above the filter 17. This provision enables the coolant to pass through the filter 17 from the top to the bottom before being injected into the storage area 10 owing to the means 16 for causing turbulence.

The storage device 1 also includes means for discharging the coolant. These means are, for example, in the form of an outlet tube 19 that passes through the peripheral wall 6 plumb over the settling chamber so as to place the latter in communication with the rest of the air conditioning loop.

FIG. 5 shows the operation of the storage device 1 according to the invention. The coolant arrives by the inlet tube 18 and is poured in the liquid state into the intake chamber 9. This coolant, including a component and a lubricant, passes through the filter 17 and accumulates on the plate 12. The coolant then passes through the means 16 so as to be injected or projected into the storage area 10. The latter is filled with coolant in the liquid state, as represented by the lines referenced 20.

In the absence of means 16 intended to cause turbulence, the lubricant and the component will separate to form two distinct layers, in which the lubricant lies above the component. The means 16, and in particular the small pipe 15, cause a restriction that will increase the speed and pressure of the coolant so as to form a jet, represented by the arrows referenced 21. This will cause mixing between the lubricant and the component, owing to circulation (arrows 22) in the storage area 10 and the creation of bubbles 23 at the core of the mixture. The stored coolant is then continuously disrupted, thereby preventing the separation of the component and the lubricant.

The permeable element 15 blocks this agitation so as to prevent bubbles 23 from entering the settling chamber 11 and so as to ensure that only the liquid state of the coolant is sent toward the outlet tube 19, then to the expansion member.

FIG. 6 shows a second alternative of the storage device 1 according to the invention. It is also a cylinder version, but with a simplified structure. Indeed, there is no plate 12 or grate between the storage area 10 and the settling chamber 11. The element 15 permeable to the coolant in this case takes the form of the filter 17. The invention therefore takes advantage of the positioning of the filter 17 in the internal volume of the storage device, at the border of the storage area 10 and the settling chamber 11, so as to confer an additional function thereon, i.e. that of preventing the passage of turbulence and/or bubbles into the settling chamber 11.

The inlet tube 18 ends with the means 16 intended to cause turbulence. In practice, the manifold 13 has a semi-circular or arc shape and is connected directly to the end 24 of the inlet tube 18. This arc formed by the manifold 13 enables the flow of coolant to be directed toward the storage area 10 so as to perform the mixing or disturbance function according to the invention. It is therefore understood that the free end 25 of the manifold 13 is opposite the storage area so as to force the coolant so that it hits the surface of the stored coolant, and thus prevents separation between the component and lubricant.

The filter 17 is then passed through by the coolant before returning to the settling chamber 11 in order to leave the device via the outlet tube 19.

FIG. 7 shows a third alternative of the invention, suitable for use with the air conditioning loop of FIG. 3.

The storage device 1 is in this case an accumulator placed on the air conditioning loop between the outlet of the evaporator and the compressor inlet. The internal volume of the device is distributed starting from the top of the diagram between a discharge chamber 26, the storage area 10 and the settling chamber 11.

The discharge chamber 26 is separated from the storage area 10 by a platform 27 through which the inlet tube 18 passes. The inlet tube 18 passes through the upper wall 7, then the discharge chamber 26, so as to then be secured by welding or brazing to the platform 27. A space is provided between the peripheral edge of the platform 27 and the internal face of the peripheral wall 6 so as to allow the coolant to rise in the gaseous state in the discharge chamber 26 while preventing the presence of coolant in the liquid state in the storage area 10.

The inlet tube 18 ends with the manifold 13, and these two elements are advantageously coaxial. The manifold 13 produces a coolant jet (in the two-phase or gaseous state), thereby causing turbulence in the coolant stored in the liquid state. This is accompanied by mixing of the component and the lubricant. This mixture ends up in the settling chamber 11 where its behavior is stabilized owing to the presence of the permeable element, in this case the filter 17.

The outlet tube 19 has a general "U" shape and originates in the discharge chamber 26 where its free end captures the coolant in the gaseous state. The outlet tube 19 passes through the platform 27, the storage area 10 and the filter 17 so as to be immersed in the settling chamber 11. A hole 28 is formed in the outlet tube 19 so as to capture a controlled part of the coolant, at this stage a mixture of component and lubricant since the means 16 intended to cause turbulence have mixed the component and the lubricant. The outlet tube 19 has a 180° curve so as to again pass through the filter 17, the storage area 10, the platform 27, the discharge chamber 26 and finally the upper wall 7 and be connected to the air conditioning loop.

FIG. 7 shows the phenomenon with the presence of bubbles 23 and circulation 22 in the storage area 10 and the absence of these same bubbles and circulation in the settling chamber 11.

The invention also covers an air conditioning loop in which the coolant circulates, the latter being comprised, for example, of the chemical compound HFO1234YF mixed with a lubricant or oil known as 100PAG or 200PAG. Said air conditioning loop includes, in the circuit, a storage device as described above.

The invention claimed is:

1. A device (1) for storing a coolant capable of circulating in an air conditioning loop, in which said device (1) includes at least one inlet tube (18), one outlet tube (19), a storage area (10) for the coolant, and an element (15) that is permeable to the coolant and placed in the internal volume of the device (1) at a border between the storage area (10) and a settling chamber (11), characterized in that said device (1) includes means (16) intended to cause turbulence in the storage area (10).

2. A device (1) according to claim 1, in which the means (16) intended to cause turbulence takes the form of a manifold (13, 14) which channels the coolant coming from an intake chamber (9) to the storage area (10).

3. A device (1) according to claim 2, in which the manifold (13, 14) is directly connected to the inlet tube (18) and has a semi-cylindrical shape, in which the free end (25) of said manifold is opposite the storage area (10).

4. A device (1) according to claim 2, in which the manifold (13, 14) is distinct from the inlet tube (18), and said the manifold (13, 14) is supported by a plate (12) that divides the internal volume of the device (1) in a sealed manner into the intake chamber (9) and the storage area (10).

5. A device (1) according to claim 2, in which the manifold (13, 14) and the inlet tube (18) are coaxial, and the inlet tube (18) passes through a discharge chamber (26) separated from the storage area (10) by a platform (27).

6. A device (1) according to claim 5, in which the manifold (13, 14) passes through the platform (27) and leads into the storage area (10).

7. A device (1) according to claim 1, in which the outlet tube (19) communicates with the settling chamber (11).

8. A device (1) according to claim 1, in which the element (15) permeable to the coolant is a grate.

9. A device (1) according to claim 1, in which the element (15) permeable to the coolant is a filter (17).

10. A device (1) according to claim 2, in which the diameter of the manifold (13, 14) is between four and eight millimeters.

11. An air conditioning loop including a storage device (1) according to claim 1 and a coolant comprised of a mixture of a component and a lubricant.

12. An air conditioning loop according to claim 11, in which the lubricant is a 100PAG or 200PAG oil and the component is a chemical component which is HFO1234YF.

13. A device (1) according to claim 3, in which the diameter of the manifold (13, 14) is between four and eight millimeters.

14. A device (1) according to claim 4, in which the diameter of the manifold (13, 14) is between four and eight millimeters.

15. A device (1) according to claim 5, in which the diameter of the manifold (13, 14) is between four and eight millimeters.

* * * * *

UNITED STATES PATENT AND TRADEMARK OFFICE

CERTIFICATE OF CORRECTION

PATENT NO. : 8,567,212 B2
APPLICATION NO. : 12/699152
DATED : October 29, 2013
INVENTOR(S) : Imed Guitari et al.

It is certified that error appears in the above-identified patent and that said Letters Patent is hereby corrected as shown below:

On the Title Page, Item (73) Assignee, after "Valeo", please delete "Systems" and replace with -- Systemes --

Signed and Sealed this
Seventeenth Day of March, 2015

Michelle K. Lee

Michelle K. Lee
*Director of the United States Patent and Trademark Office*